US007216677B2

(12) United States Patent
Fujisawa

(10) Patent No.: US 7,216,677 B2
(45) Date of Patent: May 15, 2007

(54) INDUSTRIAL TWO-LAYER FABRIC

(75) Inventor: Shigenobu Fujisawa, Shizuoka (JP)

(73) Assignee: Nippon Filcon Co. Ltd.,, Tokyo (JP)

( * ) Notice: Subject to any disclaimer, the term of this patent is extended or adjusted under 35 U.S.C. 154(b) by 26 days.

(21) Appl. No.: 11/207,940

(22) Filed: Aug. 22, 2005

(65) Prior Publication Data

US 2006/0048839 A1 Mar. 9, 2006

(30) Foreign Application Priority Data

Aug. 23, 2004 (JP) ..... 2004-242201

(51) Int. Cl.
*D21F 7/08* (2006.01)
*D21F 1/10* (2006.01)
*D03D 25/00* (2006.01)

(52) U.S. Cl. ..... 139/383 A; 139/383 AA; 162/358.2; 162/348; 162/900; 162/903

(58) Field of Classification Search ..... 139/383 A, 139/383 AA; 162/358.2, 348, 900, 903
See application file for complete search history.

(56) References Cited

U.S. PATENT DOCUMENTS 4,821,780 A * 4/1989 Tate ..... 139/383 A
4,974,642 A * 12/1990 Taipale ..... 139/383 A
4,998,569 A * 3/1991 Tate ..... 139/383 A
5,022,441 A * 6/1991 Tate et al. ..... 139/383 A
5,103,875 A * 4/1992 Tate et al. ..... 139/383 A
5,117,542 A * 6/1992 Krenkel et al. ..... 28/141
5,254,398 A * 10/1993 Gaisser ..... 442/195
5,379,808 A * 1/1995 Chiu ..... 139/383 A
5,454,405 A 10/1995 Hawes
5,456,293 A * 10/1995 Ostermayer et al. .... 139/383 A
5,542,455 A * 8/1996 Ostermayer et al. .... 139/383 A
5,713,397 A * 2/1998 Quigley ..... 139/383 A
5,829,489 A * 11/1998 Kuji ..... 139/383 A
6,202,705 B1 * 3/2001 Johnson et al. ..... 139/383 A
6,244,306 B1 6/2001 Troughton
6,860,299 B2 * 3/2005 Kuji ..... 139/383 A
7,001,489 B2 * 2/2006 Taipale et al. ..... 162/348
7,059,357 B2 * 6/2006 Ward ..... 139/348
7,073,539 B2 * 7/2006 Takimoto et al. ..... 139/383 A
2006/0048838 A1 * 3/2006 Takimoto ..... 139/383 A

OTHER PUBLICATIONS

European Search Report, Sep. 20, 2006.

* cited by examiner

*Primary Examiner*—Robert H Muromoto
(74) *Attorney, Agent, or Firm*—Rader, Fisher & Grauer PLLC

(57) ABSTRACT

In an industrial two-layer fabric, running surface side wefts constituting the running surface side layer each has a design in which the running surface side weft passes over a running surface side warp, passes under two successive running surface side warps, passes over a running surface side warp and passes under at least four successive running surface side warps, thereby forming a long crimp of the weft on the running surface side surface. A running surface side weft adjacent to the above-described weft or adjacent to the above-described weft with one weft sandwiched therebetween is arranged with a design obtained by shifting the design of the above-described weft by two running surface side warps. The design of the running surface side warps is formed of a portion passing under a running surface side weft and a portion passing over at least two running surface side wefts.

7 Claims, 14 Drawing Sheets

FIG. 4

| | 1 | 2 | 3 | 4 | 5 | 6 | 7 | 8 | 9 | 10 |
|---|---|---|---|---|---|---|---|---|---|---|
| 5c | | | | | ◇ | ◇ | | | | ◆ |
| 10' | | × | ○ | × | | × | | × | | ⊗ |
| 9' | × | | × | | × | ○ | × | | ⊗ | |
| 4c | | | ◇ | ◇ | | | | ◆ | | |
| 8' | ○ | × | | × | | × | | ⊗ | | × |
| 7' | × | | × | ○ | × | | ⊗ | | × | |
| 3c | ◇ | ◇ | | | | ◆ | | | | |
| 6' | | × | | × | | ⊗ | | × | ○ | × |
| 5' | × | ○ | × | | ⊗ | | × | | | |
| 2c | | | | ◆ | | | | | ◇ | ◇ |
| 4' | | × | | ⊗ | | × | ○ | × | | × |
| 3' | × | | ⊗ | | × | | × | | × | ○ |
| 1c | | ◆ | | | | | ◇ | ◇ | | |
| 2' | | ⊗ | | × | ○ | × | | × | | × |
| 1' | ⊗ | | × | | × | | × | ○ | × | |

FIG. 8

| | 1 | 2 | 3 | 4 | 5 | 6 | 7 | 8 | 9 | 10 | 11 | 12 |
|---|---|---|---|---|---|---|---|---|---|---|---|---|
| 6c | | | ◇ | | | ◆ | | | ◇ | | | ◆ |
| 12' | | × | | | ○ | × | | ○ | | × | | |
| 11' | | ○ | × | | | | × | | | | ⊗ | |
| 5c | ◇ | | | ◆ | | | ◇ | | | ◆ | | |
| 10' | | | ○ | × | | ○ | | × | | | | × |
| 9' | × | | | | × | | | | ⊗ | | | ○ |
| 4c | | ◆ | | | ◇ | | | ◆ | | | ◇ | |
| 8' | ○ | × | | ○ | | × | | | | × | | |
| 7' | | | × | | | | ⊗ | | | ○ | × | |
| 3c | | | ◇ | | | ◆ | | | ◇ | | | ◆ |
| 6' | | ○ | | × | | | | × | | | ○ | × |
| 5' | × | | | | ⊗ | | | ○ | × | | | |
| 2c | ◇ | | | ◆ | | | ◇ | | | ◆ | | |
| 4' | | × | | | | × | | | ○ | × | | ○ |
| 3' | | | ⊗ | | | ○ | × | | | | × | |
| 1c | | ◆ | | | ◇ | | | ◆ | | | ◇ | |
| 2' | | | | × | | | ○ | × | | ○ | | × |
| 1' | ⊗ | | | ○ | × | | | | × | | | |

FIG. 9

| | 1 | 2 | 3 | 4 | 5 | 6 | 7 | 8 | 9 | 10 | 11 | 12 |
|---|---|---|---|---|---|---|---|---|---|---|---|---|
| 6b | ◆ | | | | ◇ | ◇ | | | ◆ | ◆ | | ◆ |
| 6a | | | ◆ | ◆ | | ◆ | ◆ | | | ◇ | ◇ | |
| 12' | | | | × | | ○ | | × | ○ | | | × |
| 11' | | ⊗ | | | | × | | | | × | ○ | |
| 5b | | | ◇ | ◇ | | | ◆ | ◆ | | ◆ | ◆ | |
| 5a | ◆ | ◆ | | ◆ | ◆ | | | ◇ | ◇ | | | |
| 10' | × | | | ○ | × | | ○ | | × | | | |
| 9' | | | × | | | | × | | ○ | | × | ○ |
| 4b | ◇ | ◇ | | | ◆ | ◆ | | ◆ | ◆ | | | |
| 4a | | ◆ | ◆ | | | ◇ | ◇ | | | | ◆ | ◆ |
| 8' | | ○ | | × | ○ | | | × | | | | × |
| 7' | | × | | | | × | ○ | | | ⊗ | | |
| 3b | | | ◆ | ◆ | | ◆ | ◆ | | | | ◇ | ◇ |
| 3a | ◆ | | | ◇ | ◇ | | | | ◆ | ◆ | | ◆ |
| 6' | × | | ○ | | × | | | | × | | | ○ |
| 5' | | | × | | ○ | | × | ○ | | | × | |
| 2b | ◆ | ◆ | | ◆ | ◆ | | | | ◇ | ◇ | | |
| 2a | | ◇ | ◇ | | | | ◆ | ◆ | | ◆ | ◆ | |
| 4' | ○ | | | × | | | | × | | ○ | | × |
| 3' | | × | ○ | | | ⊗ | | | | × | | |
| 1b | | ◆ | ◆ | | | | ◇ | ◇ | | | ◆ | ◆ |
| 1a | ◇ | | | | ◆ | ◆ | | ◆ | ◆ | | | ◇ |
| 2' | × | | | | × | | | ○ | × | | ○ | |
| 1' | ○ | | × | ○ | | | × | | | | × | |

FIG. 10

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| 14c | | | ◆ | | | | ◆ | | | ◇ | | | | ◇ |
| 14' | | × | × | | | ○ | | | ⊗ | × | | | | |
| 13c | | | | | ◇ | | | ◆ | | | ◇ | | | ◆ |
| 13' | | ○ | | × | × | | | | | | × | × | ○ | |
| 12c | ◆ | | | | ◆ | | | ◇ | | | | ◇ | | |
| 12' | × | | | ○ | | | ⊗ | × | | | | | | × |
| 11c | | | ◇ | | | ◆ | | | ◇ | | | ◆ | | |
| 11' | | × | × | | | | | | × | × | ○ | | | ○ |
| 10c | | | ◆ | | | ◇ | | | | ◇ | | | ◆ | |
| 10' | | ○ | | | ⊗ | × | | | | | | × | × | |
| 9c | ◇ | | | ◆ | | | ◇ | | | ◆ | | | | |
| 9' | × | | | | | | × | × | ○ | | | ○ | | × |
| 8c | ◆ | | | ◇ | | | | ◇ | | | ◆ | | | |
| 8' | | | ⊗ | × | | | | | | × | × | | | ○ |
| 7c | | ◆ | | | ◇ | | | ◆ | | | | | ◇ | |
| 7' | | | | | × | × | ○ | | | ○ | | × | × | |
| 6c | | ◇ | | | | ◇ | | | ◆ | | | | ◆ | |
| 6' | ⊗ | × | | | | | | × | × | | | ○ | | |
| 5c | | | ◇ | | | ◆ | | | | | ◇ | | | ◆ |
| 5' | | | × | × | ○ | | | ○ | | × | × | | | |
| 4c | | | | ◇ | | | ◆ | | | | ◆ | | | ◇ |
| 4' | | | | | | × | × | | | ○ | | | ⊗ | × |
| 3c | ◇ | | | ◆ | | | | | ◇ | | | ◆ | | |
| 3' | × | × | ○ | | | ○ | | × | × | | | | | |
| 2c | | ◇ | | | ◆ | | | | ◆ | | | ◇ | | |
| 2' | | | | × | × | | | ○ | | | ⊗ | × | | |
| 1c | | ◆ | | | | | ◇ | | | ◆ | | | ◇ | |
| 1' | ○ | | | ○ | | × | × | | | | | | × | × |

FIG. 11

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| 7c | | | | | ◇ | | | ◆ | | | | | | ◆ |
| 14 | | | × | × | | | ○ | | | ○ | | | | |
| 13 | | ○ | | | | | | | | × | × | | ○ | |
| 6c | | | ◇ | | | ◆ | | | | | | ◆ | | |
| 12' | × | × | | | ○ | | | ○ | | | | | | |
| 11' | | | | | | | | × | × | | ○ | | | ○ |
| 5c | ◇ | | | ◆ | | | | | | ◆ | | | | |
| 10' | | | ○ | | | ○ | | | | | | | × | × |
| 9' | | | | | | × | × | | ○ | | | ○ | | |
| 4c | | ◆ | | | | | | ◆ | | | | | ◇ | |
| 8' | ○ | | | ○ | | | | | | | × | × | | |
| 7' | | | | × | × | | ○ | | | ○ | | | | |
| 3c | | | | | | ◆ | | | | | ◇ | | | ◆ |
| 6' | | ○ | | | | | | | × | × | | | ○ | |
| 5' | | × | × | | ○ | | | ○ | | | | | | |
| 2c | | | | ◆ | | | | | ◇ | | | ◆ | | |
| 4' | | | | | | | × | × | | | ○ | | | ○ |
| 3' | × | | ○ | | | ○ | | | | | | | | × |
| 1c | | ◆ | | | | | ◇ | | | ◆ | | | | |
| 2' | | | | | × | × | | | ○ | | | ○ | | |
| 1' | ○ | | | ○ | | | | | | | | × | × | |

FIG. 12

| | 1 | 2 | 3 | 4 | 5 | 6 | 7 | 8 | 9 | 10 |
|---|---|---|---|---|---|---|---|---|---|---|
| 10c | | | ◇ | | | | | | ◆ | |
| 10' | × | | × | | × | ○ | × | ○ | × | |
| 9c | | | | | | ◆ | | | | ◇ |
| 9' | | × | ○ | × | ○ | × | | × | | × |
| 8c | | | ◆ | | | | ◇ | | | |
| 8' | × | ○ | × | | × | | × | | × | ○ |
| 7c | | | | ◇ | | | | | | ◆ |
| 7' | | × | | × | | × | ○ | × | ○ | × |
| 6c | ◇ | | | | | | ◆ | | | |
| 6' | × | | × | ○ | × | ○ | × | | × | |
| 5c | | | | ◆ | | | | ◇ | | |
| 5' | ○ | × | ○ | × | | × | | × | | × |
| 4c | ◆ | | | | ◇ | | | | | |
| 4' | × | | × | | × | | × | ○ | × | ○ |
| 3c | | ◇ | | | | | | ◆ | | |
| 3' | | × | | × | ○ | × | ○ | × | | × |
| 2c | | | | | ◆ | | | | ◇ | |
| 2' | × | ○ | × | ○ | × | | × | | × | |
| 1c | | ◆ | | | | ◇ | | | | |
| 1' | ○ | × | | × | | × | | × | ○ | × |

INDUSTRIAL TWO-LAYER FABRIC

TECHNICAL FIELD OF THE INVENTION

The present invention relates to a two-layer fabric used for transport, dehydration and the like, particularly a two-layer fabric suited for papermaking.

BACKGROUND ART

Fabrics obtained by weaving warps and wefts have conventionally been used widely as an industrial fabric. They are, for example, used in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, or are capable of maintaining conditions necessary for making good paper for a prolonged period of time. In addition, fiber supporting property, improvement in a papermaking yield, good water drainage property, wear resistance, dimensional stability and running stability are demanded. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by use of the papermaking fabric as a representative example.

An increase in the papermaking speed of a paper machine needs reinforcement of a dehydration power, because it leads to an increase in the dehydration speed. A multilayer fabric needs a drainage hole penetrating from an upper surface side layer toward a running surface side layer so that a fabric having a structure that upper surface side warps and running surface side warps, and upper surface side wefts and running surface side wefts are vertically overlapped is preferred. Misalignment of yarns constituting the upper surface side layer and yarns constituting the running surface side layer narrows a drainage hole penetrating from the upper surface side layer toward the running surface side layer, and in such a case, excessive suction must be required. When a suction force is raised, loss of fibers or fillers or bite of a wet web into a wire increases, or sticking of fibers occurs, which deteriorates wet web releasability when the wet web is transferred to a felt, or sometimes leads to remarkable generation of wire marks. In addition, owing to a high speed travel, a papermaking fabric wears gradually on a running surface side thereof, which is in contact with the machine, by the friction with a roll or the like and owing to such a phenomenon, the life of the fabric sometimes runs out. In order to improve wear resistance, a variety of measures must be taken, for example, by adopting a weft wear type design or changing the material of a yarn. It is the common practice to use a yarn with a larger diameter in order to impart the fabric with wear resistance. This measure is effective for improving the wear resistance, but not effective for attaining excellent surface property. In Japanese Patent Laid-Open No. 2001-355191, an example of undesirable overlap between upper surface side warps and running surface side warps is shown. As an example of a structure in which a long crimp of a running surface side weft is formed in a running surface side layer as illustrated in FIG. 4 of Japanese Patent Laid-Open No. 2001-355191, a 10-shaft fabric having a structure in which a running surface side weft passes over a running surface side warp, passes under a running surface side warp, passes over a running surface side warp, and passes under seven successive running surface side warps, thereby forming a long crimp can be mentioned. Transfer of yarns does not occur easily during running of the fabric, because wefts are woven twice per cycle. Since in a portion of a running surface side weft which passes over a running surface side warp, passes under a running surface side warp and then passes over a running surface side warp, however, two warps having a running surface side weft woven upward get closer toward a running surface side warp arranged therebetween. As a result, these three yarns get closer and as illustrated in FIG. 4 of Japanese Patent Laid-Open No. 2001-355191, running surface side warps are not arranged straight. Since the upper surface side warps and running surface side warps do not overlap vertically, a water draining property which papermaking fabrics must have and air permeability which fabrics for transport must have are not attained.

SUMMARY OF THE INVENTION

With the forgoing problems in view, the present invention has been made. An object of the present invention is to provide, in an at least 16-shaft two-layer fabric obtained by weaving an upper surface side layer and a running surface side layer by a binding yarn, an industrial two-layer fabric improved in the superposition of the upper and lower yarns constituting the fabric and excellent in water drainage property, fiber supporting property, surface property, binding power, rigidity, and wear resistance by employing a design, for running surface side wefts forming the running surface side layer, in which the running surface side wefts each passes over a running surface side warp, passes under two successive running surface side warps, passes over a running surface side warp and then passes under at least four successive running surface side warps, thereby forming a crimp on the surface of the running surface side surface; arranging a running surface side weft adjacent to the above-described running surface side weft or adjacent to the above-described running surface side weft with one weft sandwiched therebetween with a design obtained by shifting the above-described design by two running surface side warps; and constituting the running surface side warps from a portion passing under a running surface side weft and a portion passing over at least two running surface side wefts.

The present invention relates to an industrial two-layer fabric obtained by weaving an upper surface side layer made of upper surface side warps and upper surface side wefts and a running surface side layer made of running surface side warps and running surface side wefts by binding yarns. The running surface side wefts constituting the running surface side layer each has a design in which the running surface side weft passes over a running surface side warp, passes under two successive running surface side warps, passes over a running surface side warp and passes under at least four successive running surface side warps, thereby forming a long crimp of the weft on the running surface side surface. A running surface side weft adjacent to the above-described weft or adjacent to the above-described weft with one weft sandwiched therebetween is arranged with a design obtained by shifting the design of the above-described weft by two running surface side warps. The design of the running surface side warps is formed of a portion passing under a running surface side weft and a portion passing over at least two running surface side wefts.

A complete design or a repeating unit of the running surface side layer constituting the two-layer fabric may be made of n (n stands for an even number of 8 or greater) running surface side warps and n/2 running surface side wefts. The running surface side wefts each may pass over a running surface side warp, pass under two successive running surface side warps, pass over a running surface side warp, and pass under n−4 successive running surface side warps, thereby forming a long crimp on the running surface side surface. In any two adjacent running surface side wefts, one may be arranged with a design obtained by shifting the design of the other one by two running surface side warps. The running surface side warps may have a design in which each running surface side warp passes under a running surface side weft, and then passes over n/2−1 running surface side wefts.

A complete design or a repeating unit of the running surface side layer constituting the two-layer fabric may be made of n (n stands for an even number of 8 or greater) running surface side warps and n running surface side wefts. The running surface side wefts each may pass over a running surface side warp, pass under two successive running surface side warps, pass over a running surface side warp, and pass under n−4 successive running surface side warps, thereby forming a long crimp on the running surface side surface. In any two adjacent running surface side wefts, a portion of the one running surface side weft which passes over a running surface side warp, passes under two successive running surface side warps and passes over a running surface side warp may always be adjacent to a portion of the other running surface side weft which forms a long crimp corresponding to at least four warps. In any two running surface side wefts adjacent to each other with one weft sandwiched therebetween, the one running surface side weft may be arranged with a design obtained by shifting the design of the other running surface side weft by two running surface side warps. The running surface side warps may have a design in which each of the warps passes under a running surface side weft, passes over at least two running surface side wefts, passes under a running surface side weft, and then passes over at least 2 running surface side wefts.

A complete design or a repeating unit of the running surface side layer constituting the two-layer fabric may be made of n (n stands for an even number of 8 or greater) running surface side warps and n/2 running surface side wefts. The running surface side wefts each may pass over a running surface side warp, pass under two successive running surface side warps, pass over a running surface side warp, and pass under n−4 successive running surface side warps, thereby forming a long crimp on the running surface side surface. In any two running surface side wefts adjacent to each other, a portion of the one running surface side weft which passes over a running surface side warp, passes under two successive running surface side warps and passes over a running surface side warp may be adjacent to a portion of the other running surface side weft which forms a long crimp corresponding to at least four warps; in any two running surface side wefts adjacent to each other with one weft sandwiched therebetween, the one running surface side weft is arranged with a design obtained by shifting the design of the other running surface side weft by two running surface side warps. The running surface side warps may have a design in which the running surface side warps each passes under a running surface side weft and passes over n−1 running surface side wefts.

The binding yarns for weaving the upper surface side layer with the running surface side layer may be arranged between the wefts, have a smaller diameter than the upper surface side wefts and have a structure preventing the protrusion of the binding yarns from the surface.

The binding yarns for weaving the upper surface side layer with the running surface side layer may be arranged in pairs between the upper surface side wefts. One of the binding yarns may be woven with the upper surface side warp to form the upper surface side surface, while below the upper surface side surface, the other binding yarn may be woven with the running surface side warp to bind the two layers. The two binding yarns as a pair may be woven with the upper surface side warp and running surface side warp alternately to form the upper surface side surface design.

A design of the upper surface side surface formed by the upper surface side warps and upper surface side wefts, or by the upper surface side warps, upper surface side wefts and auxiliary weft binding yarns may be a plain weave design. Alternatively, a design of the upper surface side surface formed by the upper surface side warps and upper surface side wefts, or by the upper surface side warps, upper surface side wefts and auxiliary weft binding yarns may be a twill weave or broken twill weave design.

In a two-layer fabric obtained by weaving an upper surface side layer and a running surface side layer by a binding yarn, employment of a design in which a running surface side weft forming the running surface side layer passes over a running surface side warp, passes under two successive running surface side warps, passes over a running surface side warp and then passes under at least four successive running surface side warps, thereby forming a crimp on the surface of the running surface side; arrangement of a running surface side weft adjacent to the above-described running surface side weft or adjacent to the above-described running surface side weft with one weft inserted therebetween with a design obtained by shifting the above-described design by two running surface side warps; and formation of the design of a running surface side warp from a portion passing under a running surface side weft and a portion passing over at least two running surface side wefts improve the overlap between upper and lower yarns constituting the fabric and bring about excellent effects on water drainage property, fiber supporting property, surface property, binding power, rigidity and abrasion resistance.

BRIEF DESCRIPTION OF THE DRAWINGS

FIG. 4 is a design diagram of an industrial two-layer fabric according to Example 3 of the present invention.

FIG. 8 is a design diagram of an industrial two-layer fabric according to Example 5 of the present invention.

FIG. 9 is a design diagram of an industrial two-layer fabric according to Example 6 of the present invention.

FIG. 10 is a design diagram of an industrial two-layer fabric according to Example 7 of the present invention.

FIG. 11 is a design diagram of an industrial two-layer fabric according to Example 8 of the present invention.

FIG. 12 is a design diagram of an industrial two-layer fabric according to Conventional Example 1.

DETAILED EXPLANATION OF THE INVENTION

Figure 1:
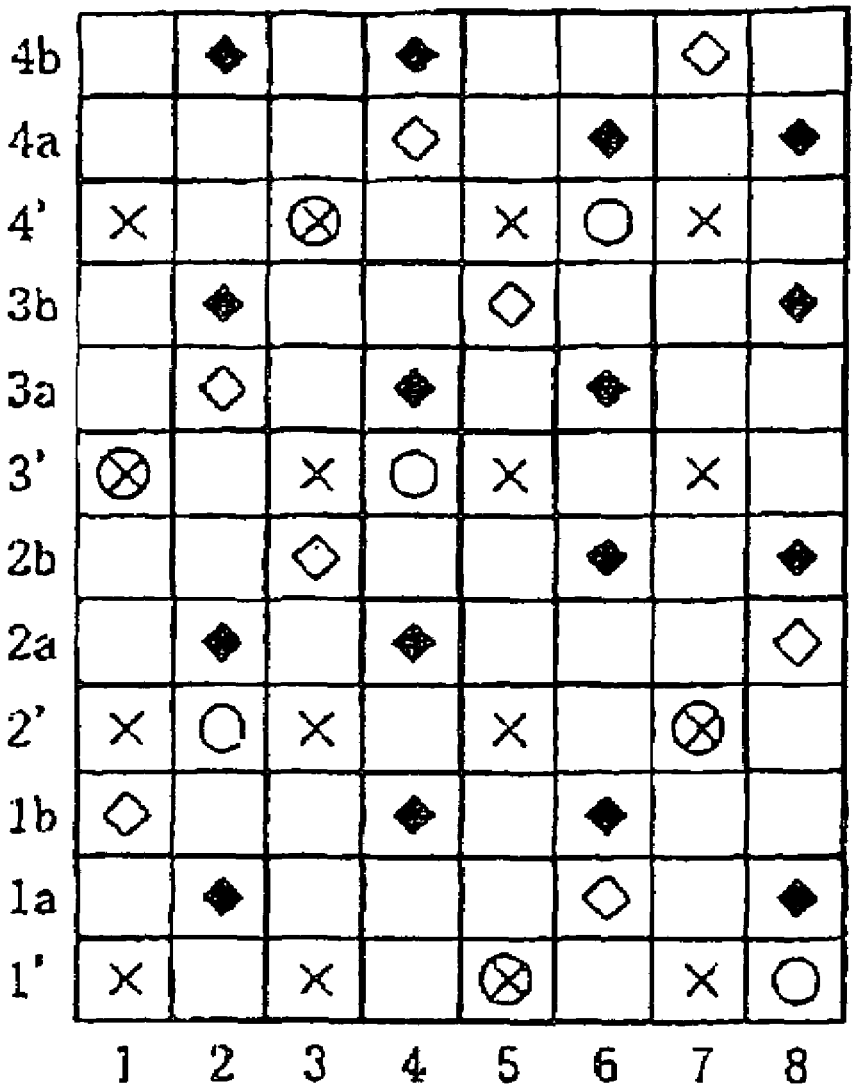
FIG. 1 is a design diagram of an industrial two-layer fabric according to Example 1 of the present invention.

The industrial fabric of the present invention is used as an industrial fabric for papermaking wires, conveyor belts and filter cloths. In particular, it can be used preferably for papermaking wires on which a severe requirement is imposed by users.

The two-layer fabric of the present invention having an upper surface side layer and a running surface side layer woven by a binding yarn and being equipped with at least 16 shafts is obtained by employing a design in which a running surface side weft passes over a running surface side warp, passes under at least two successive running surface side warps, passes over a running surface side warp and passes under at least four running surface side warps, thereby forming a long crimp on the running surface side surface; arranging a running surface side weft, which is adjacent to the above-described running surface side weft or adjacent to the above-described running surface side weft with one weft sandwiched therebetween, with a design obtained by shifting the above-described design by two running surface side warps; and forming the design of a running surface side warp from a portion passing under a running surface side weft and a portion passing over at least two running surface side wefts.

Employment of the above-described running surface side weft design improves wear resistance, because a long crimp of the running surface side weft having a length corresponding to at least four running surface side warps is formed on the running surface side surface. In addition, in a portion of the running surface side weft which passes over a running surface side warp, passes under two successive running surface side warps, and passes over a running surface side warp, the running surface side weft is firmly woven from both sides thereof by two running surface side warps with two running surface side warps sandwiched therebetween so that the resulting fabric has excellent rigidity. Successive arrangement of two running surface side wefts which are adjacent to each other or adjacent to each other with one weft sandwiched therebetween with a design obtained by shifting two running surface side warps improves the overlap between the upper surface side warps and running surface side warps, whereby a drainage hole penetrating from the upper surface side layer toward the running surface side layer is formed. In a portion of the running surface side weft which passes over a running surface side warp, passes under two successive running surface side warps and then passes over a running surface side warp, a force usually acts on the two running surface side warps located on both sides to bring them closer and therefore moves them so that overlap with the upper surface side warps located just above them tends to deteriorate. In the fabric of the present invention, on the other hand, drainage holes are formed uniformly all over the fabric without misalignment between the upper surface side warps and running surface side warps because of the design of running surface side wefts which are adjacent each other or adjacent to each other with one weft sandwiched therebetween. Details of it will be described later by using Examples.

In the present invention, the running surface side warps have a design that it passes under a running surface side weft, and then passes over at least two successive running surface side wefts. When the running surface side warp is caused to pass under two successive running surface side wefts, many running surface side warps appear from the running surface side surface, which sometimes leads to deterioration in wear resistance. When two running surface side wefts adjacent to each other have a same design, formation of uneven spaces between the wefts sometimes occurs undesirably.

Proposed in one example of the present invention is a fabric wherein the running surface side layer has a complete design made of n (n stands for an even number of 8 or greater) running surface side warps and n−1 running surface side wefts; the running surface side wefts each has a design in which it passes over a running surface side warp, passes under two successive running surface side warps, passes over a running surface side warp, and passes under n−4 successive running surface side warps, thereby forming a long crimp on the running surface side surface; a running surface side weft arranged adjacent to the above-described running surface side weft is arranged with a design obtained by shifting the above-described design by two running surface side warps; and the running surface side warps each has a design in which it passes under a running surface side weft, and then passes over n/2−1 running surface side wefts.

Proposed in another example of the present invention is a fabric wherein the running surface side layer has a complete design made of n running surface side warps and n running surface side wefts; the running surface side wefts each has a design in which it passes over a running surface side warp, passes under two successive running surface side warps, passes over a running surface side warp, and passes under n−4 successive running surface side warps, thereby forming a long crimp on the running surface side surface; in any two adjacent running surface side wefts, a portion of the one running surface side weft which passes over a running surface side warp, passes under two successive running surface side warps and passes over a running surface side warp is adjacent to a portion of the other running surface side weft forming a long crimp corresponding to at least four warps; a running surface side weft arranged adjacent to the above-described running surface side weft with one weft sandwiched therebetween is arranged with a design obtained by shifting the above-described design by two running surface side warps; and the running surface side warps each has a design in which it passes under a running surface side weft, passes over at least two running surface side wefts, passes under a running surface side weft and then passes over at least two running surface side wefts.

Proposed in a further example of the present invention is a fabric wherein the running surface side layer has a complete design made of n running surface side warps and n/2 running surface side wefts; the running surface side wefts each has a design in which it passes over a running surface side warp, passes under two successive running surface side warps, passes over a running surface side warp, and passes under n−4 successive running surface side warps, thereby forming a long crimp on the running surface side surface; in any two adjacent running surface side wefts, a portion of the one running surface side weft which passes over a running surface side warp, passes under two successive running surface side warps and passes over a running surface side warp is adjacent to a portion of the other running surface side weft forming a long crimp corresponding to at least four warps; a running surface side weft arranged adjacent to the above-described running surface side weft with one weft sandwiched therebetween is arranged with a design obtained by shifting the above-described design by two running surface side warps; and the running surface side warps each has a design in which it passes under a running surface side weft, and passes over n−1 running surface side wefts.

As described above, the running surface side wefts each has a design in which it passes over a running surface side warp, passes under two successive running surface side warps, passes over a running surface side warp, and passes under at least 4 successive running surface side warps, thereby forming a long crimp over the running surface side surface; a running surface side weft adjacent to the above-described running surface side weft or adjacent to the above-described running surface side weft with one weft sandwiched therebetween is arranged with a design obtained by shifting the above-described design by two running surface side warps.

No particular limitation is imposed on the design of the upper surface side layer and it can be selected as needed, depending on the intended use of the fabric. Papermaking fabrics need excellent surface property so that the upper surface side layer of the present invention may have a design selected from plain weave, twill weave, broken twill weave, satin weave or the like as needed. Employment of a design depending on the number of shafts of the fabric is recommended. It may be any design, for example, a 1/3 design in which an upper surface side warp passes over a upper surface side weft and then passes under three successive upper surface side wefts, or a 2/1 design in which an upper surface side warp passes over two upper surface side wefts and then passes under an upper surface side weft.

The number of the upper surface side warps, upper surface side wefts, running surface side warps and running surface side wefts constituting the fabric of the present invention can be selected as needed. A 16-shaft fabric may be composed of 8 upper surface side warps and running surface side warps and 4 upper surface side wefts and running surface side wefts; 8 upper surface side warps, running surface side warps and upper surface side wefts and 4 running surface side wefts; or 8 upper surface side warps, upper surface side wefts, running surface side warps and running surface side wefts. A 10-shaft fabric may be composed of 10 upper surface side warps and running surface side warps and 5 upper surface side wefts and running surface side wefts; or 10 upper surface side warps, running surface side warps, and upper surface side wefts and 5 running surface side wefts. In addition, a 12-shaft fabric, 18-shaft fabric, 24-shaft fabric or the like can be formed at need. A ratio of the number of the upper surface side wefts and running surface side wefts may be set at 2:1 or 1:1, or it may be 3:2 or the like. In addition, there is, for example, a fabric having four upper surface side wefts and four running surface side wefts, or a fabric having ten upper surface side wefts and five running surface side wefts. When the upper surface side is made dense and the running surface side surface is made rough, excellent water drainage property can be attained without losing excellent surface property and fiber supporting property.

A binding yarn for weaving the upper surface side layer and the running surface side layer is preferably arranged between wefts. In the case of an 8-shaft design, a binding yarn passes over an upper surface side warp, passes between three upper surface side warps and running surface side warps, passes under two running surface side warps and then passes between two upper surface side warps and running surface side warps. In this case, the binding yarn preferably has a small diameter and has a design and a material quality permitting prevention of its protrusion from the upper surface side surface. A binding yarn may be arranged between upper surface side wefts, or may be arranged relative to two or three upper surface side wefts. Of course, not only one binding yarn, but also at least two binding yarns may be arranged between the upper surface side wefts. Instead, the binding yarn may be used similar to the upper surface side weft as an auxiliary weft binding yarn for forming the design of an upper surface side surface. For example, two auxiliary weft binding yarns are arranged between the upper surface side wefts and below one of the auxiliary weft binding yarns woven with an upper surface side warp to form an upper surface side surface, the other auxiliary weft binding yarn is woven with a running surface side warp to bind two layers. These auxiliary weft binding yarns also serve as a yarn for forming an upper surface side surface so that they do not need to have a smaller diameter than the conventional binding yarn, do not generate a local recess which will otherwise occur by their lead-in, and attain both good surface property and binding power. They are therefore preferred. The designs of these two auxiliary weft binding yarns may be the same or different. An auxiliary weft having no binding function may be arranged in addition to a binding yarn or auxiliary weft binding yarn, or an auxiliary weft may be arranged in combination with an auxiliary weft binding yarn.

Although a yarn to be used in the present invention may be selected depending on its using purpose, examples of it include, in addition to monofilaments, multifilaments, spun yarns, finished yarns subjected to crimping or bulking such as so-called textured yarn, bulky yarn and stretch yarn and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

As the upper surface side warps, running surface side warps and upper surface side wefts of a papermaking wire, use of a polyester monofilament having rigidity and excellent dimensional stability is usually preferred. For the binding yarn, use of a polyamide monofilament which does not cause shower resistance, fibrillation resistance and resistance to internal wear is preferred. For running surface side wefts which need wear resistance, interweaving of polyester monofilaments and polyamide monofilaments while arranging them alternately is preferred, because it improves wear resistance while maintaining rigidity.

EXAMPLES

Referring to accompanying drawings, embodiments of the present invention will hereinafter be described based on examples.

Figure 5:
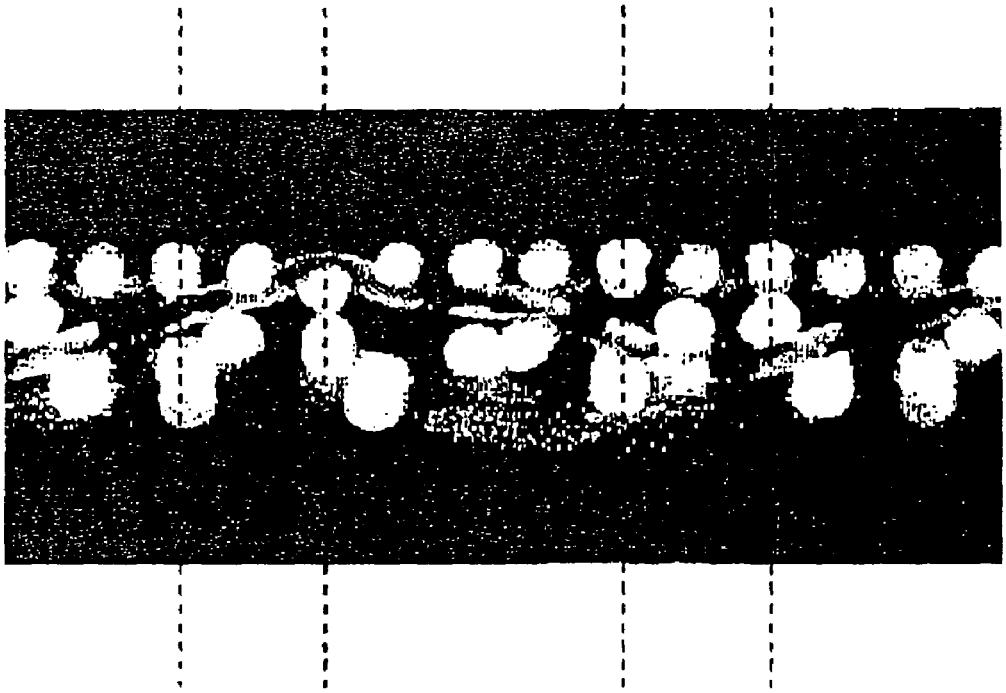
FIG. 5 is a cross-section photograph of FIG. 4 along wefts.
Figure 6:
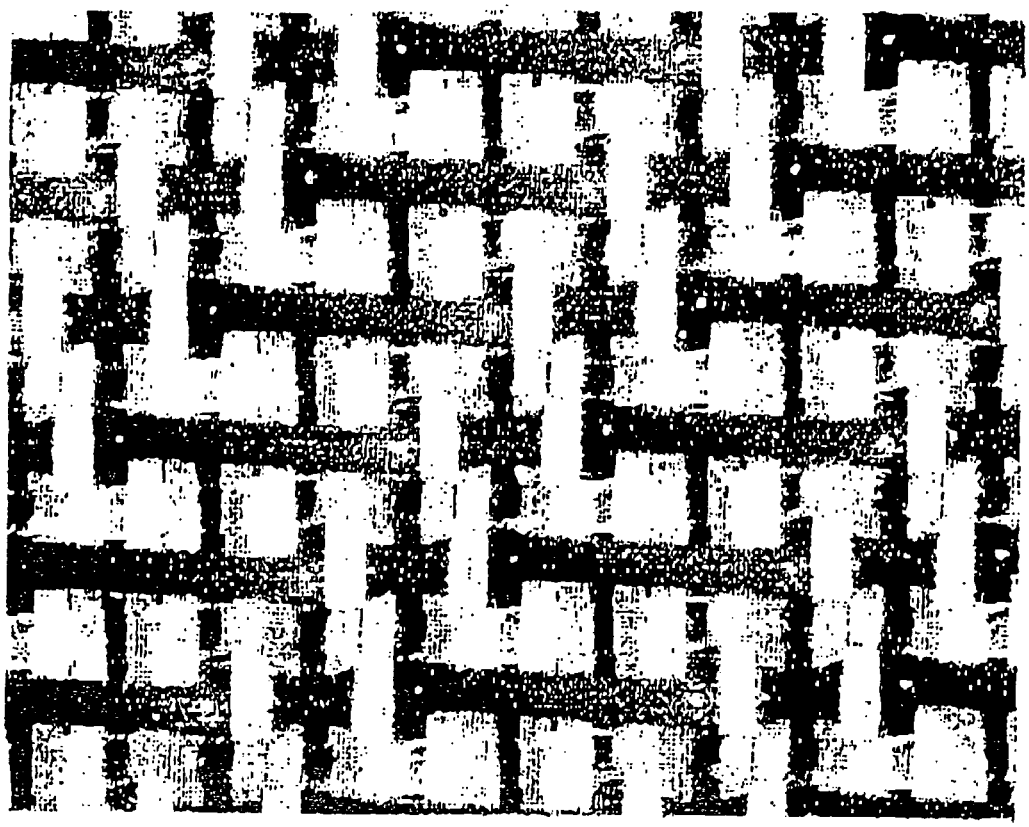
FIG. 6 is a photograph of the running surface side surface of FIG. 4.
Figure 13:
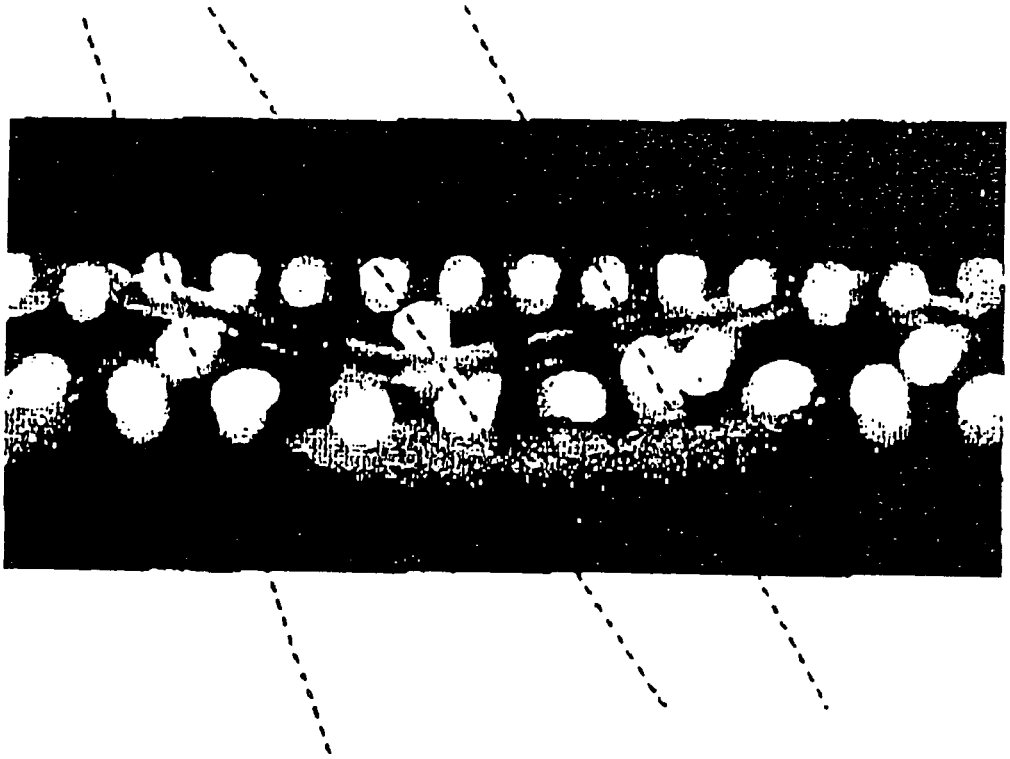
FIG. 13 is a cross-section photograph of FIG. 12 along wefts.
Figure 14:
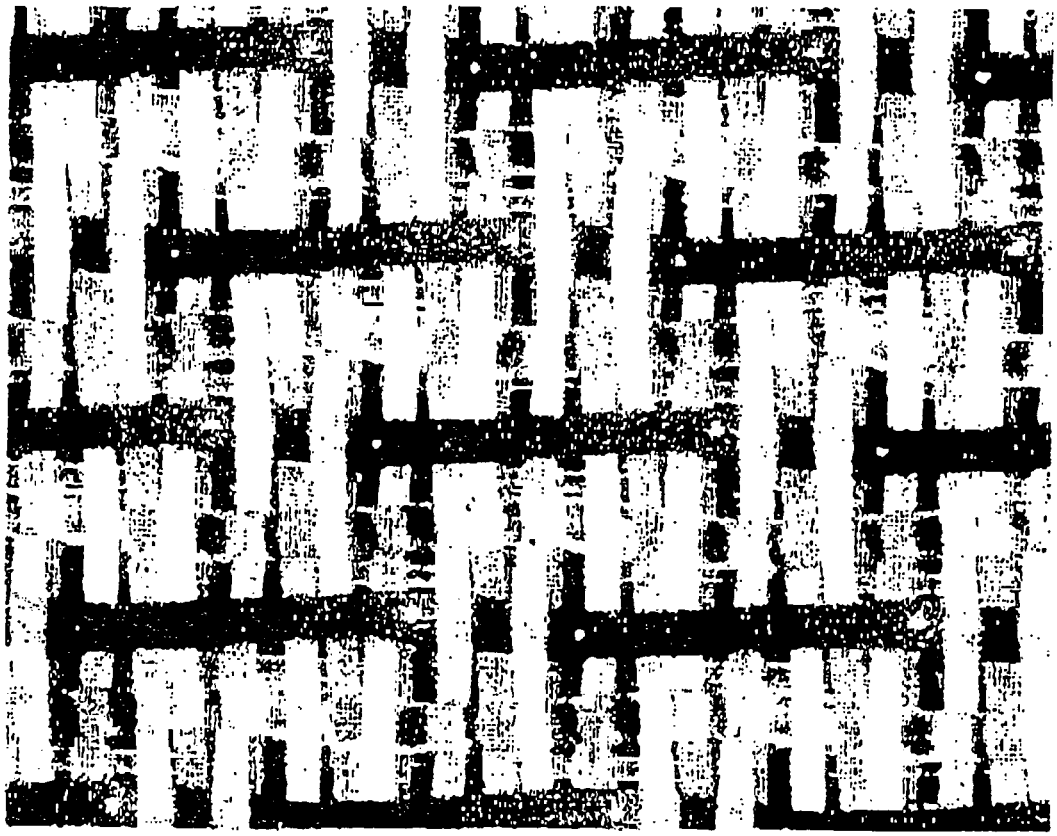
FIG. 14 is a photograph of the running surface side surface of FIG. 12.

FIGS. 1, 3, 4, and 7 through 11 are design diagrams illustrating complete designs obtained in examples of the present invention. The term "complete design" as used herein means a minimum recurring unit of a fabric design and a whole fabric design is formed by connecting this complete design vertically and horizontally. FIG. 2 is a cross-sectional view taken along wefts 2', 3' and 4' of the fabric of FIG. 1. FIG. 5 is a cross-sectional photograph taken along a weft of the fabric of FIG. 4. FIG. 6 is a photograph of the running surface side surface of the fabric of FIG. 4. FIG. 12 is a design diagram illustrating the complete design of a conventional example. FIG. 13 is a cross-sectional photograph taken along a weft of the fabric of FIG. 12. FIG. 14 is a photograph of the running surface side surface of the fabric of FIG. 12.

In the design diagrams, warps are indicated by Arabic numerals, for example 1, 2 and 3, while wefts are indicated by Arabic numerals with a prime, for example, 1', 2' and 3', binding yarns are indicated by Arabic numerals with c, for example, 1*c*, 2*c* and 3, and a pair of auxiliary weft binding yarns having a binding function while forming the upper surface side surface are denoted by 1*a* and 1*b*, 2*a* and 2*b*, and 3*a* and 3*b*.

In the diagram, a cross "×" means that an upper surface side warp lies over an upper surface side weft, an open circle "○" indicates that a running surface side warp lies under a running surface side weft, a solid square "◆" indicates that a binding yarn or an auxiliary weft binding yarn lies over an upper surface side weft, and an open square "◇" indicates that a binding yarn or an auxiliary weft binding yarn lies under a running surface side warp.

Figure 2:
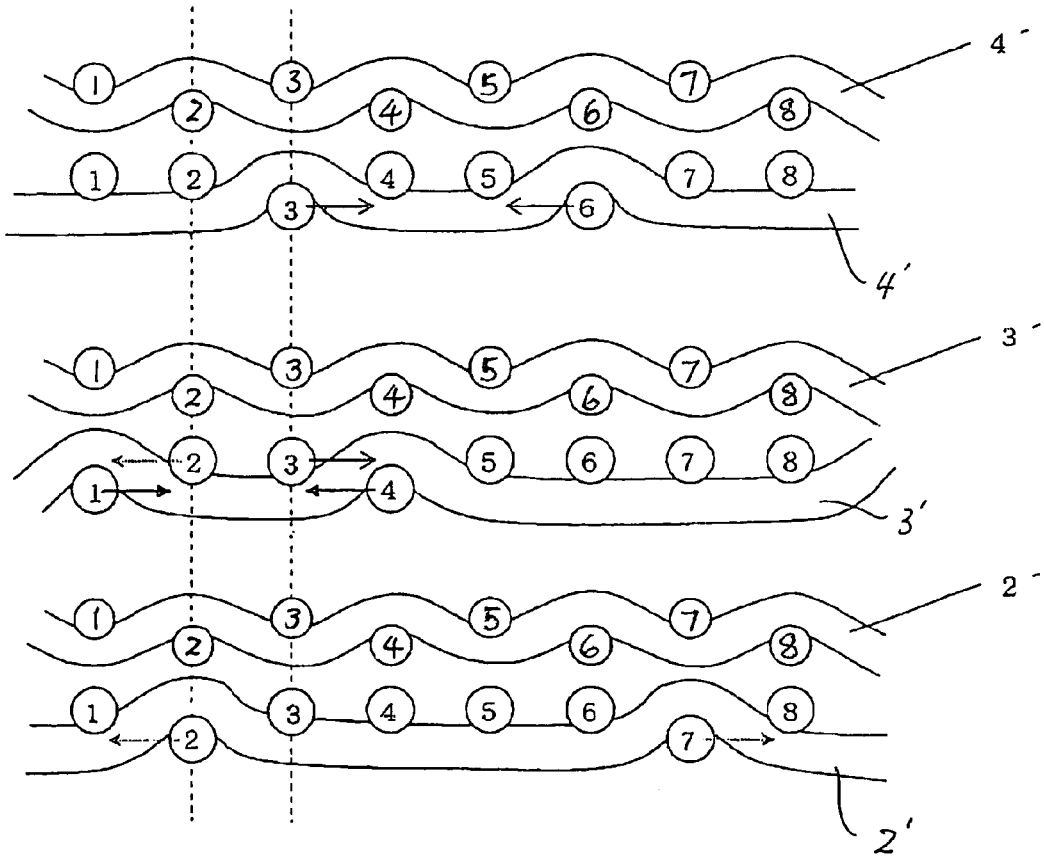
FIG. 2 is a cross-sectional view of the fabric of FIG. 1 along wefts 2', 3' and 4'.

FIG. 1 illustrates a repeating unit of a 16-shaft fabric according to one example of the present invention in which auxiliary weft binding yarns having an upper surface side surface forming function and a binding function are arranged in pairs between wefts. Upper surface side wefts and running surface side wefts are arranged at a ratio of 1:1 and a pair of auxiliary weft binding yarns is arranged per weft.

Figure 3:
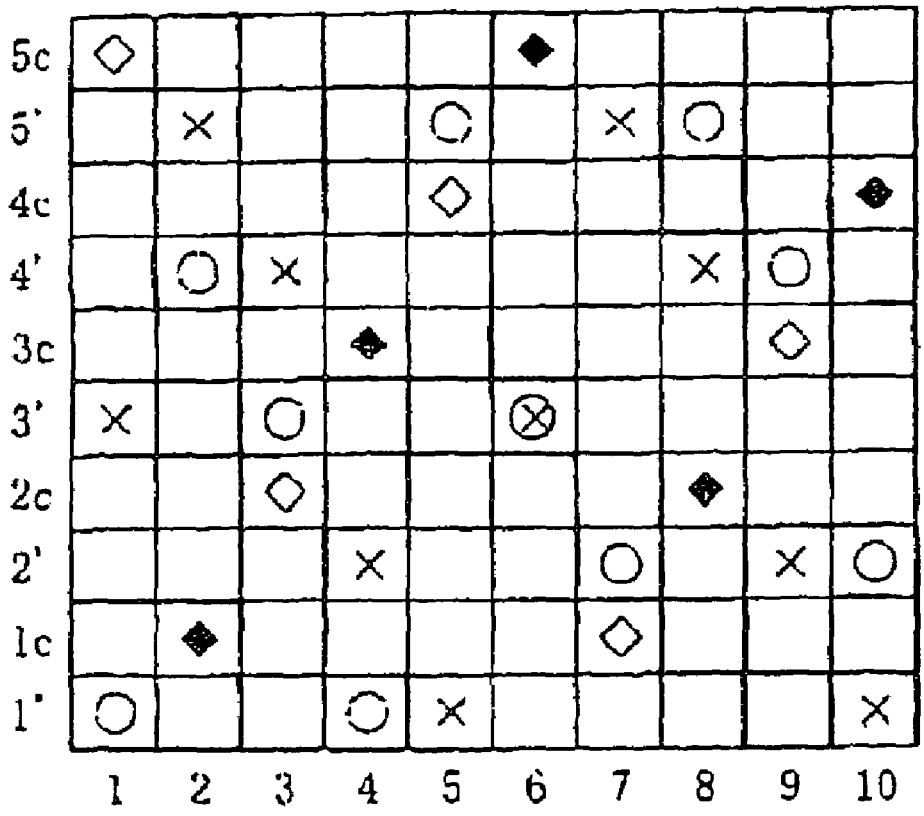
FIG. 3 is a design diagram of an industrial two-layer fabric according to Example 2 of the present invention.

FIG. 3 illustrates a repeating unit of a 20-shaft fabric according to another example of the present invention in which binding yarns having a smaller diameter than upper surface side wefts are arranged alternately with wefts. Upper surface side wefts and running surface side wefts are arranged at a ratio of 1:1 and a binding yarn is arranged per weft.

FIG. 4 illustrates a repeating unit of a 20-shaft fabric according to a further example of the present invention in which binding yarns having a smaller diameter than upper surface side weft are arranged alternately with wefts. Upper surface side wefts and running surface side wefts are arranged at a ratio of 1:1 and a binding yarn is arranged per two wefts.

Figure 7:
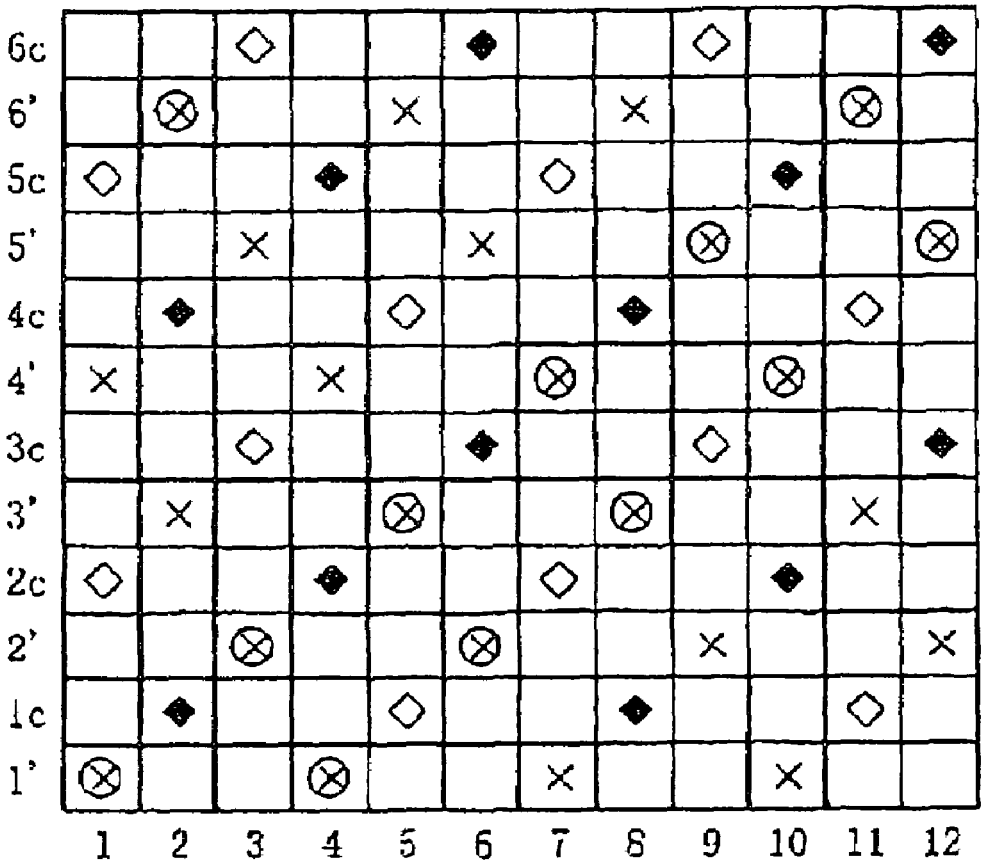
FIG. 7 is a design diagram of an industrial two-layer fabric according to Example 4 of the present invention.

FIG. 7 illustrates a repeating unit of a 24-shaft fabric according to a still further example of the present invention in which binding yarns having a smaller diameter than upper surface side wefts are arranged alternately with wefts. Upper surface side wefts and running surface side wefts are arranged at 1:1 and a binding yarn is arranged per weft.

FIG. 8 illustrates a repeating unit of a 24-shaft fabric according to a still further example of the present invention in which binding yarns having a smaller diameter than upper surface side wefts are arranged alternately with wefts. Upper surface side wefts and running surface side wefts are arranged at 1:1 and a binding yarn is arranged per two wefts.

FIG. 9 illustrates a repeating unit of a 24-shaft fabric according to a still further example of the present invention in which auxiliary weft binding yarns having an upper surface side surface forming function and a binding function are arranged in pairs between wefts. Upper surface side wefts and running surface side wefts are arranged at a ratio of 1:1 and a pair of auxiliary weft binding yarns is arranged per two wefts.

FIG. 10 illustrates a repeating unit of a 28-shaft fabric according to a still further example of the present invention in which binding yarns having a smaller diameter than upper surface side wefts are arranged alternately with wefts. Upper surface side wefts and running surface side wefts are arranged at a ratio of 1:1 and a binding yarn is arranged per weft.

FIG. 11 illustrates a repeating unit of a 28-shaft fabric according to a still further example of the present invention in which a binding yarn having a smaller diameter than upper surface side wefts is arranged between wefts at a ratio of 1:2. Upper surface side wefts and running surface side wefts are arranged at 1:1 and a binding yarn is arranged per two wefts.

FIG. 12 illustrates a repeating unit of a 20-shaft fabric according to a conventional example in which binding yarns having a smaller diameter than upper surface side wefts are arranged alternately with wefts. Upper surface side wefts and running surface side wefts are arranged at a ratio of 1:1 and a binding yarn is arranged per weft.

Example 1

In the design diagram of FIG. 1, yarns in the warp direction are denoted by Arabic numerals 1, 2, 3, 4, 5, 6, 7, and 8 and upper surface side warps and running surface side warps are arranged vertically. Yarns denoted by Arabic numerals with a prime 1', 2', 3' and 4' are wefts and upper surface side wefts and running surface side wefts are arranged vertically. Between the wefts, auxiliary weft binding yarns having both an upper surface side surface forming function and a binding function, 1*a* and 1*b*, 2*a* and 2*b*, 3*a* and 3*b*, and 4*a* and 4*b* are arranged in pairs.

On the upper surface side surface, the two auxiliary weft binding yarns are caused to function as one upper surface side weft and upper surface side warps, upper surface side wefts and pairs of auxiliary weft binding yarns constitute a plain weave. Described specifically, the auxiliary weft binding yarns 1*a* and 1*b* lie under the upper surface side warp 1, while the 1*a* and 1*b* located over and under the upper surface side warp 2, respectively. The 1*a* and 1*b* lie under the upper surface side warp 3, while the 1*b* and 1*a* lie over and under the upper surface side warp 4, respectively. The 1*a* and 1*b* lie under the upper surface side warp 5, while the 1*b* and 1*a* lie over and under the upper surface side warp 6, respectively. The 1*a* and 1*b* lie under the upper surface side warp 7, while the 1*a* and 1*b* lie over and under the upper surface side warp 8, respectively. When the yarns 1*a* and 1*b* are regarded as one pair, the pairs of the auxiliary weft binding yarns are arranged in the order of under, over, under, over, under, over, under, and over an upper surface side warp. In this manner, the auxiliary weft binding yarns form, together with the upper surface side warps, a plain weave. Here, the upper surface side wefts and auxiliary weft binding yarns have the same surface design and a plain weave design is adopted for the whole surface of a fabric. The upper surface side weft and the auxiliary weft binding yarn may have the same or different design and a design other than plain weave may be adopted.

One of the pair of the auxiliary weft binding yarns forms the upper surface side surface, below which the other binding auxiliary weft binding yarn is arranged under the upper surface side layer and weaves the upper surface side layer and the running surface side layer, passing under at least one running surface side warp. Since the pair of auxiliary weft binding yarns serves as one upper surface side weft and does not break the upper surface side surface design, excellent surface property can be attained. It is recommended to make the diameter of the upper surface side weft and auxiliary weft binding yarn equal in order to improve the surface property. In the fabric obtained in this Example, two layers are woven firmly by two auxiliary weft binding yarns so that two-layer fabric is not separated easily and has excellent binding strength.

The running surface side layer has a design in which a running surface side weft passes over a running surface side warp, passes under two successive running surface side warps, passes over a running surface side warp and then pass under four successive running surface side warps, thereby forming a long crimp on the running surface side surface. The design of the running surface side weft 2' arranged adjacent to the running surface side weft 1' is arranged while shifting the design of the running surface side weft 1' by two warps. The designs of the wefts 3' adjacent to the weft 2' and then the weft 4' are also complete designs obtained by arranging while shifting by two warps. Arrangement of wefts while shifting by two running surface side warps improves the overlap between upper surface side warps and running surface side warps, leading to the formation of a dewatering hole penetrating from the upper surface side layer toward the running surface side layer.

The overlap between upper surface side warps and running surface side warps will next be described specifically based on FIG. 2. The running surface side weft 3' has a design in which it passes over the one running surface side warp 1, passes under the two successive running surface side warps 2 and 3, passes over the one running surface side warp 4 and then passes under the four running surface side warps 5, 6, 7 and 8. In a portion of the design as described in this Example in which a running surface side weft passes over a running surface side warp, passes under two successive running surface side warps and passes over a running surface side warp, a force to move the warps existing on both sides, that is, running surface side warps 1 and 4 toward the running side surface warps 2 and 3 inside thereof works and these two warps 2 and 3 get closer to the running surface side warps 1 and 4. When the upper surface side warps are arranged at regular intervals, the positions of the running surface side warps do not overlap with them. When the weft 3' is cited as an example, forces to move the running surface side warp 1 and running surface side warp 4 toward the running surface side warp 2 and running surface side warp 3 inside thereof work in the running surface side weft 3', which brings the running surface side wefts 1 to 4 close to each other. Usually, their positions do not vertically overlap with those of the upper surface side warps 1 to 4 existing thereover. In the design according to the present invention, on the other hand, the running surface side warps 1 and 2 scarcely move to the right side of the diagram owing to the relationship with the design of the running surface side weft 2' and running surface side weft 4' which are located on both sides of the running surface side weft 3'. In addition, the running surface side warps 3 and 4 scarcely move to the left side of the diagram so that the running surface side warps can be arranged almost right under the upper surface side warps, respectively.

In the running surface side weft 3', a force to move the running surface side warp 1 and running surface side warp 4 toward the running surface side warp 2 and the running surface side warp 3 inside thereof works, while in the weft 4' arranged adjacent to the running surface side weft 3', a force to move the running surface side warp 3 toward the right side of the diagram works owing to a similar action. The running surface side warp 3 hardly moves its position, because forces toward two opposite directions are offset between the running surface side weft 4' and the running surface side weft 3'. In other words, the running surface side warp 3 is arranged almost just under the upper surface side warp 3. This also applies to the running surface side warp 2. In the running surface side weft 3', a force to move the running surface side warp 1 toward the running surface side warp 2, while in the running surface side weft 2' arranged adjacent to the weft 3', a force to move the running surface side warp 2 toward the left side of the diagram. The running surface side warp 2 hardly moves its position, because forces toward two opposite directions are offset between the running surface side weft 2' and the running surface side weft 3'. In other words, the running surface side warp 2 is arranged almost just under the upper surface side warp 2. Such actions improve the overlap between all the upper surface side warps and running surface side warps and make it possible to form a water drainage space penetrating through the upper surface side layer to the running surface side layer, thereby attaining a sufficient water drainage property.

In addition, since a long crimp of a running surface side weft having a length corresponding to four running surface side warps is formed on the running surface side surface in this design of the running surface side weft, the resulting fabric has excellent wear resistance. Moreover, in a portion in which a running surface side weft passes over a running surface side warp, passes under two successive running surface side warps, and then passes over a running surface side warp, a running surface side weft is woven firmly by two running surface side warps with two warps sandwiched therebetween so that the resulting fabric has excellent rigidity.

Example 2

In the design diagram of FIG. 3, the fabric in this example has, arranged between wefts, binding yarns for binding two vertical layers of the fabric and they are denoted by 1*c*, 2*c*, 3*c*, 4*c* and 5*c*, respectively.

In the design of an upper surface side surface, an upper surface side warp passes over an upper surface side weft and then passes under four successive upper surface side wefts. A broken twill weave design is formed as a whole by arranging such a design while shifting it as needed. Formation of a long crimp of the upper surface side weft on the upper surface side surface contributes to improve the fiber supporting property of a weft.

Binding yarns are arranged between wefts at a ratio of 1:1. The design of each of binding yarns is that it passes over an upper surface side warp, passes between four upper surface side warps and running surface side warps, passes under a running surface side warp and passes between four upper surface side warps and running surface side warps. Since these binding yarns do not participate in the surface design, it is recommended to make the diameter of the binding yarns smaller than that of the upper surface side wefts and at the same time to prevent marked protrusion from the upper surface side surface.

In the running surface side layer, a running surface side weft has a design in which it passes over a running surface side warp, passes under two successive running surface side warps, passes over a running surface side warp and then passes under six successive running surface side warps, thereby forming a long crimp on the running surface side surface. A running surface side weft adjacent to the above-described running surface side weft with one weft sandwiched therebetween is arranged while shifting the design by two warps. Described specifically, the running surface side weft 3' adjacent to the running surface side weft 1' with one weft sandwiched therebetween has a design obtained by shifting the design of the running surface side weft 1' by two warps and the running surface side weft 5' adjacent to the weft 3' with one weft sandwiched therebetween has a design obtained by shifting the design of the running surface side weft 3' by two warps. The running surface side weft 4' adjacent to the running surface side weft 2' with one weft sandwiched therebetween has also a design obtained by shifting the design of the running surface side weft 2' by two warps, and the running surface side weft 6' adjacent thereto with one weft therebetween has a design obtained by shifting the design of the running surface side weft 4' by two warps. In such a manner, a complete design of the running surface side wefts is formed by shifting any two running surface side wefts adjacent to each other with one weft sandwiched therebetween by two warps. In addition, a portion (which will hereinafter be called "woven portion") of a running surface side weft which passes over a running surface side warp, passes under two successive running surface side warps, and then passes over a running surface side warp is adjacent to a portion of a running surface side weft which is adjacent to the above-described weft and forms a long crimp corresponding to 6 warps. Described specifically, a long crimp extending on the warps 1 to 6 of the running surface side weft 2' is formed adjacent to a portion of the running surface side weft 1' which passes over a running surface side warp, passes under two successive running surface side warps, and then passes over a running surface side warp, that is a portion of the warps 1 to 4 of the running surface side weft 1'. In the running surface side weft 3' adjacent to the weft 2', a woven portion made of the warps 3 to 6 is located. Similar relationship exists in the other running surface side wefts.

Employment of such a design improves the overlap between upper surface side warps and running surface side warps and enables formation of a drainage hole penetrating from an upper surface side layer toward a running surface side layer. In Example 1, the overlap of warps owes to the action of a force by the design of running surface side wefts right adjacent thereto. Even insertion of a running surface side weft between them as in this Example is preferred, because if a long crimp forming portion is located adjacent to the woven portion, an action of a force to move a warp is not inhibited and deterioration in the overlap of warps do not occur.

In this running surface side weft design, a long crimp of a running surface side weft having a length corresponding to 6 running surface side warps is formed on the running surface side surface so that the resulting fabric has improved wear resistance. In addition, in a portion of a running surface side weft which passes over a running surface side warp, passes under two successive running surface side warps, and passes over a running surface side warp, the running surface side weft is firmly woven in two running surface side warps with two warps sandwiched therebetween so that the resulting fabric has excellent rigidity.

Example 3

In the diagram of FIG. 4, the fabric of this example has a binding yarn arranged relative to two wefts. Since it has, as a surface design on the upper surface side, a plain weave design in which warps and wefts are woven alternately, arrangement of a binding yarn brings about excellent effects in fiber supporting property and surface property.

In a binding design, a binding yarn passes over an upper surface side warp, passes through four upper surface side warps and running surface side warps, passes under two running surface side warps and then passes between three upper surface side warps and running surface side warps. The cross-section photograph of FIG. 5 taken along a weft facilitates understanding of it. Since the binding yarn does not participate in the surface design, it is recommended to make the diameter of the binding yarn smaller than that of the upper surface side weft and at the same time to prevent marked protrusion from the upper surface side surface. A binding yarn is arranged relative to two wefts. Two layers are woven firmly each other so that problems such as delamination do not occur.

The running surface side layer has a design in which a running surface side weft passes over a running surface side warp, passes under two successive running surface side warps, passes over a running surface side warp, and passes under six successive running surface side warps, thereby forming a long crimp over the running surface side surface. Any two running surface side wefts adjacent to each other with one weft sandwiched therebetween are arranged by shifting the design by two warps. Described specifically, the running surface side weft 3' adjacent to the running surface side weft 1' with one weft sandwiched therebetween is arranged with a design obtained by shifting the design of the running surface side weft 1' by two warps. The running surface side weft 5' adjacent to the weft 3' with one weft sandwiched therebetween is arranged with a design obtained by shifting the design of the running surface side weft 3' by two warps. This also applies to the running surface side wefts 7' and 9'. The running surface side weft 4' adjacent to the running surface side weft 2' with one weft sandwiched therebetween is arranged with a design obtained by shifting the design of the running surface side weft 2' by two warps. The running surface side weft 6' adjacent to the running surface side weft 4' with one weft sandwiched therebetween is arranged with a design obtained by shifting the design of the running surface side weft 4' by two warps. This also applies to the running surface side wefts 8' and 10'. As can be understood from the running surface side surface illustrated in FIG. 6, a running surface side weft has a polyester monofilament and a polyamide monofilament, which are different in color, arranged alternately, and the design of the running surface side weft is shifted by two warps to obtain the design of a running surface side weft adjacent thereto with one weft sandwiched therebetween. In any two adjacent running surface side wefts, a potion of one running surface side weft which passes over a running surface side warp, passes under two successive running surface side warps and passes over a running surface side warp is adjacent to a portion of the other running surface side weft forming a long crimp extending over 6 warps. Described specifically, adjacent to the warps 8 to 10 which correspond to a portion of the running surface side weft 1' which passes over a running surface side warp, passes under two successive running surface side warps and then passes over a running surface side warp, a long crimp extending over the warps 6 to 10 and 1 of the running surface side weft 2' is formed. The running surface side weft 3' adjacent to the weft 2' has a woven portion composed of the warps 10 and 1 to 3. Similar relationship exists in the other running surface side wefts.

Employment of such a design improves overlap between upper surface side warps and running surface side warps and enables the formation of a drainage hole penetrating from the upper surface side layer toward the running surface side layer, because of similar reasons to those described in Example 1. In Example 1, the overlap of wefts owes to the action of a force of the design of a running surface side weft just adjacent thereto. Even insertion of one running surface side weft between two running surface side wefts as in this Example is preferred, because the action of a force to move the warps is not disturbed and the overlap between warps is not deteriorated if a portion forming a long crimp is adjacent to the woven portion. As can be seen from FIG. 5, upper surface side warps and running surface side warps almost overlap each other vertically. A cross-section photograph taken along a weft of a conventional example is shown in FIG. 13. Comparison with it shows that the overlap is superior in present example. It can be understood also from FIG. 6 that a uniform drainage space is formed all over the fabric. Comparison with the photograph of the running surface side surface of the conventional example in FIG. 14 shows that a uniform drainage space is formed in the present example.

In addition, in this running surface side weft design, a long crimp of a running surface side weft having a length corresponding to six running surface side warps is formed on the running surface side surface so that the resulting fabric has improved wear resistance. In a portion of the running surface side weft which passes over a running surface side warp, passes under two successive running surface side warps and passes over a running surface side warp, the running surface side wefts are firmly woven by the running surface side warps with two warps sandwiched therebetween so that the fabric has excellent rigidity.

Example 4

In the design diagram of FIG. 7, a fabric of this example has one binding yarn arranged per weft. The upper surface side surface has a design in which an upper surface side warp passes over an upper surface side weft and then passes under two upper surface side wefts. This design is excellent in the fiber supporting property by wefts, because many wefts appear from the upper surface side surface.

In the binding design, a binding yarn passes over a upper surface side warp, passes between two upper surface side warps and running surface side warps, passes under a running surface side warp, passes between two upper surface side warps and running surface side warps, passes over an upper surface side warp, passes between two upper surface side warps and running surface wide warps, passes under a running surface side warp, and passes between two upper surface side warps and running surface side warps. This binding yarn does not participate in the surface design so it is recommended to make the diameter of the binding yarn smaller than that of the upper surface side weft and at the same time to prevent marked protrusion from the upper surface side surface.

In the design of the running surface side layer, a running surface side weft passes over a running surface side warp, passes under two successive running surface side warps, passes over a running surface side warp, and passes under eight successive running surface side warps, thereby forming a long crimp over the running surface side surface. A running surface side weft adjacent to the weft is arranged with a design obtained by shifting the above-described design by two warps. Described specifically, a running surface side weft 2' adjacent to a running surface side weft 1' is arranged with a design obtained by shifting the design of the running surface side weft 1' by two warps. A running surface side weft 3' adjacent to the weft 2' is arranged with a design obtained by shifting the design of the running surface side weft 2' by two warps. This also applies to running surface side wefts 4' to 6'. Employment of such a design improves the overlap between upper surface side warps and running surface side warps and enables formation of a drainage hole penetrating from the upper surface side layer toward the running surface side layer because of similar reasons to those as described in Example 1.

In addition, in this running surface side weft design, a long crimp of a running surface side weft having a length corresponding to eight running surface wide warps is formed on the running surface side surface so that the resulting fabric has improved wear resistance. Moreover, the fabric thus obtained has excellent rigidity, because in a portion of a running surface side weft which passes over a running surface side warp, passes under two successive running surface side warps and passes over a running surface side warp, the running surface side weft is firmly woven by two running surface side warps with two warps sandwiched therebetween.

Example 5

In the design diagram of FIG. 8, a fabric of this example has a binding yarn arranged per two wefts. In the design of an upper surface side surface, an upper surface side warp passes over an upper surface side weft and passes under three upper surface side wefts. In this design, many wefts appear from the upper surface side so that fiber supporting property by wefts is excellent.

The binding design is similar to that of Example 4 illustrated in FIG. 7. Since this binding yarn does not participate in the surface design, it is recommended to make the diameter of the binding yarn smaller than that of an upper surface side weft and at the same time, to prevent marked protrusion from the upper surface side surface.

In the design of a running surface side layer, a running surface side weft passes over a running surface side warp, passes under two successive running surface side warps, passes over a running surface side warp, and passes under eight successive running surface side warps, thereby forming a long crimp on the running surface side surface. A running surface side weft adjacent to the above-described weft with a weft sandwiched therebetween is arranged with a design obtained by shifting the above-described design by two warps. Described specifically, a running surface side weft 3' adjacent to a running surface side weft 1' with one weft sandwiched therebetween is arranged with a design obtained by shifting the design of the running surface side weft 1' by two warps. A running surface side weft 5' adjacent to the running surface side weft 3' with one weft sandwiched therebetween is arranged with a design obtained by shifting the design of the running surface side weft 3' by two warps. This similarly applies to running surface side wefts 7', 9' and 11'. A running surface side weft 4' adjacent to a running surface side weft 2' with one weft sandwiched therebetween is also arranged with a design obtained by shifting the design of the running surface side weft 2' by two warps. A running surface side weft 6' adjacent to a running surface side weft 4' with one weft sandwiched therebetween is arranged with a design obtained by shifting the design of the running surface side weft 4' by two warps. This similarly applies to running surface side wefts 8', 10' and 12'. In two running surface side wefts adjacent to each other, a portion of a running surface side weft which passes over a running surface side warp, passes under two successive running surface side warps and passes over a running surface side warp is adjacent to a portion of the other running surface side weft which forms a long crimp corresponding to 8 warps. Described specifically, a long crimp extending over the warps 11, 12 and 1 to 6 of the running surface side weft 2' is formed adjacent to a portion of the running surface side weft 1' which passes over a running surface side warp, passes under two successive running surface side warps and passes over a running surface side warp, that is a portion of the warps 1 to 4 of the running surface side weft 1'. The running surface side weft 3' adjacent to the weft 2' has a woven portion made of the warps 3 to 6. A similar relationship to the above-described one also exists in the other running surface side wefts.

Employment of such a design improves the overlap of upper surface side warps and running surface side warps and enables the formation of a drainage hole penetrating from the upper surface side layer toward the running surface side layer, because of similar reasons to those described in Example 1. The overlap of warps owes to the action of a force of the design of running surface side wefts just adjacent thereto. Even insertion of a running surface side weft between running surface side wefts as in this Example is preferred, because if the long crimp formation portion is located adjacent to the woven portion, an action of a force to move a warp is not inhibited and the overlap of warps is not deteriorated.

In this running surface side weft design, a long crimp of running surface side wefts having a length corresponding to eight running surface side warps is formed on the running surface side surface so that the resulting fabric has improved wear resistance. In addition, in a portion of a running surface side weft which passes over a running surface side warp, passes under two successive running surface side warps, and passes over a running surface side warp, the running surface side weft is firmly woven by two running surface side warps with two warps sandwiched therebetween so that the resulting fabric has excellent rigidity.

Example 6

In the design diagram of FIG. 9, a fabric of this example has, arranged between wefts, a pair of auxiliary weft binding yarns having a function of forming an upper surface side surface and a binding function.

On the upper surface side surface, two auxiliary weft binding yarns are caused to function as one upper surface side weft. An upper surface side warp has a design in which it passes over an upper surface side weft and passes under three upper surface side wefts. An auxiliary weft binding yarn has a design in which it passes over two upper surface side warps, passes between an upper surface side warp and a running surface wide warp, passes over two upper surface side warps, passes between two upper surface side warps and running surface side warps, passes under two running surface side warps, and then passes between three upper surface side warps and running surface side warps. A pair of auxiliary weft binding yarns repeatedly has a design in which it passes over two upper surface side warps of the upper surface side surface and then passes under an upper surface wide warp. One of the auxiliary weft binding yarns in pair forms the upper surface side surface, below which the other one is arranged below the upper surface side layer, and weaves the upper surface side layer and the running surface side layer, passing under two running surface side warps. Since the pair of auxiliary weft binding yarns forms an upper surface side surface design alternately, it functions as an upper surface side weft and does not destroy the surface design. A fabric having excellent surface property can therefore be obtained. The fabric available by this example has excellent binding strength, because two layers are woven firmly by the pair of auxiliary weft binding yarns and do not separate easily.

In the running surface side layer, a running surface side weft passes over a running surface side warp, passes under two successive running surface side warps, passes over a running surface side warp, and passes under eight successive running surface side warps, thereby forming a long crimp on the running surface side surface. A running surface side weft adjacent to the above-described weft with one weft sandwiched therebetween is arranged with a design obtained by shifting the above-described design by two warps. Described specifically, a running surface side weft 3' adjacent to a running surface side weft 1' with a weft sandwiched therebetween is arranged with a design obtained by shifting the design of the running surface side weft 1' by two warps. A running surface side weft 5' adjacent to the running surface side weft 3' with a weft sandwiched therebetween is arranged with a design obtained by shifting the design of the running surface side weft 3' by two warps. This also applies to running surface side wefts 7', 9' and 11'. A running surface side weft 4' adjacent to a running surface side weft 2' with a weft sandwiched therebetween is also arranged with a design obtained by shifting the design of the running surface side weft 2' by two warps. A running surface side weft 6' adjacent to the running surface side weft 4' with a weft sandwiched therebetween is arranged with a design obtained by shifting the design of the running surface side weft 4' by two warps. This also applies to running surface side wefts 8', 10' and 12'. In two running surface side wefts adjacent to each other, a portion of the one running surface side weft which passes over a running surface side warp, passes under two successive running surface side warps and passes over a running surface side warp is adjacent to a portion of the other running surface side weft which forms a long crimp corresponding to 8 warps. Described specifically, a long crimp extending over the warps 12 and 1 to 7 of the running surface side weft 2' is formed adjacent to a portion of the running surface side weft 1' which passes over a running surface side warp, passes under two successive running surface side warps and passes over a running surface side warp, that is, the warps 1 to 4 of the running surface side weft 1'. The running surface side weft 3' adjacent to the weft 2' has a woven portion made of the warps 3 to 6. A similar relationship to the above-described one also exists in the other running surface side wefts.

Employment of such a design improves the overlap between upper surface side warps and running surface side warps and enables formation of a drainage hole penetrating from the upper surface side layer to the running surface side layer, because of similar reasons to those described in Example 1. In Example 1, the overlap of warps owes to the action of a force caused by the design of running surface side wefts right adjacent thereto. Even insertion of an additional running surface side weft between them as in this Example is preferred, because if a long crimp formation portion is located adjacent to the woven portion, the action of a force to move a warp does not occur and the overlap of warps is not deteriorated.

In this running surface side weft design, a long crimp of running surface side wefts having a length corresponding to eight running surface side warps is formed on the running surface side surface, which improves wear resistance. In addition, in a portion of a running surface side weft which passes over a running surface side warp, passes under two successive running surface side warps, and passes over a running surface side warp, the running surface side weft is firmly woven by two running surface side warps with two warps sandwiched therebetween so that the resulting fabric has excellent rigidity.

Example 7

In the design diagram of FIG. 10, a fabric of this example has a binding yarn arranged per weft. In an upper surface side surface, an upper surface side warp passes over an upper surface side weft, and then passes under two upper surface side wefts. This design permits appearance of many wefts from the upper surface side surface so that it is excellent in fiber supporting property by wefts.

This fabric has two binding designs and they are alternately arranged. Since binding yarns do not participate in the surface design, it is recommended to make the diameter of the binding yarns smaller than that of the upper surface side wefts and at the same time to prevent their marked protrusion from the upper surface side surface.

In the design of a running surface side layer, a running surface side weft passes over a running surface side warp, passes under two successive running surface side warps, passes over a running surface side warp, and passes under ten successive running surface side warps, thereby forming a long crimp on the running surface side surface. A running surface side weft adjacent to the above-described weft with one weft sandwiched therebetween is arranged with a design obtained by shifting the above-described design by two warps. Described specifically, a running surface side weft 3' adjacent to a running surface side weft 1' with one weft sandwiched therebetween is arranged with a design obtained by shifting the design of the running surface side weft 1' by two warps. A running surface side weft 5' adjacent to the weft 3' with one weft sandwiched therebetween is arranged with a design obtained by shifting the design of the running surface side weft 3' by two warps. This equally applies to running surface side wefts 7', 9', 11' and 13'. A running surface side weft 4' adjacent to a running surface side weft 2' with one weft sandwiched therebetween is arranged with a design obtained by shifting the design of the running surface side weft 2' by two warps. A running surface side weft 6' adjacent to the weft 4' with one weft sandwiched therebetween is arranged with a design obtained by shifting the design of the running surface side weft 4' by two warps. This also applies to running surface side wefts 8', 10', 12' and 14'. In two running surface side wefts adjacent to each other, a portion of the one running surface side weft which passes over a running surface side warp, passes under two successive running surface side warps and passes over a running surface side warp is adjacent to a portion of the other running surface side weft which forms a long crimp corresponding to ten warps. Described specifically, a long crimp extending over warps 12 to 14 and 1 to 7 of the running surface side weft 2' is formed adjacent to a portion of the running surface side weft 1' which passes over a running surface side warp, passes under two successive running surface side warps and passes over a running surface side warp, that is, warps 1 to 4 of the running surface side weft 1'. The running surface side weft 3' adjacent to the weft 2' has a woven portion made of the warps 3 to 6. A similar relationship exists in the other running surface side wefts.

Employment of such a design improves the overlap of upper surface side warps and running surface side warps and enables formation of a drainage hole penetrating from an upper surface side layer to a running surface side layer, because of similar reasons to those described in Example 1. In Example 1, the overlap of warps owes to the action of a force due to the design of running surface side wefts right adjacent thereto. Even insertion of one running surface side weft between these wefts as in this Example is preferred, because if a long crimp formation portion is located adjacent to the woven portion, the action of a force to move the warps does not occur and the overlap of warps is not deteriorated.

In this running surface side weft design, a long crimp of a running surface side weft having a length corresponding to ten running surface side warps is formed on the running surface side surface so that the resulting fabric has improved wear resistance. In addition, in a portion of a running surface side weft which passes over a running surface side warp, passes under two successive running surface side warps, and passes over a running surface side warp, the running surface side weft is firmly woven by two running surface side warps with two warps sandwiched therebetween so that the resulting fabric has excellent rigidity.

Example 8

In the design diagram of FIG. 11, a fabric of this example has one binding yarn arranged relative to two wefts. In the design of an upper surface side surface, an upper surface side warp passes over a upper surface side weft, passes under eight upper surface side wefts, passes over a upper surface side weft and then passes under four upper surface side wefts. This design is excellent in fiber supporting property by wefts, because it permits appearance of many wefts from the upper surface side surface.

In a binding design, a binding yarn passes over an upper surface side warp, passes between four upper surface side warps and running surface side warps, passes under a running surface side warp, passes between two upper surface side warps and running surface side warps, passes over an upper surface side warp and then passes between five upper surface side warps and running surface side warps. Since the binding yarn does not participate in the surface design, it is recommended to make the diameter of the binding yarn smaller than that of the upper surface side weft and at the same time to prevent marked protrusion from the upper surface side surface.

In the design of a running surface side layer, a running surface side weft passes over a running surface side warp, passes under two successive running surface side warps, passes over a running surface side warp, and passes under ten successive running surface side warps, thereby forming a long crimp on the running surface side surface. A running surface side weft adjacent to the above-described weft with a weft sandwiched therebetween is arranged with a design obtained by shifting the above-described design by two warps. Described specifically, a running surface side weft 3' adjacent to a running surface side weft 1' with one weft sandwiched therebetween is arranged with a design obtained by shifting the design of the running surface side weft 1' by two warps. A running surface side weft 5' adjacent to the weft 3' with one weft sandwiched therebetween is arranged with a design obtained by shifting the design of the running surface side weft 3' by two warps. This equally applies to the design of each of running surface side wefts 7', 9', 11' and 13'. A running surface side weft 4' adjacent to a running surface side weft 2' with one weft sandwiched therebetween is also arranged with a design obtained by shifting the design of the running surface side weft 2' by two warps. A running surface side weft 6' adjacent to the weft 4' with one weft sandwiched therebetween is arranged with a design obtained by shifting the design of the running surface side weft 4' by two warps. This equally applies to the design of each of running surface side wefts 8', 10', 12' and 14'. In two running surface side wefts adjacent to each other, a portion of the one running surface side weft which passes over a running surface side warp, passes under two successive running surface side warps and passes over a running surface side warp is adjacent to a portion of the other running surface side weft which forms a long crimp corresponding to ten warps. Described specifically, a long crimp extending over the warps 13, 14 and 1 to 8 of the running surface side weft 2' is formed adjacent to a portion of the running surface side weft 1' which passes over a running surface side warp, passes under two successive running surface side warps and passes over a running surface side warp, that is a portion of the warps 1 to 4 of the running surface side weft 1'. The running surface side weft 3' adjacent to the weft 2' has a woven portion made of the warps 3 to 6. A similar relationship to the above-described one exists in the other running surface side wefts.

Employment of such a design improves the overlap of upper surface side warps and running surface side warps and enables formation of a drainage hole penetrating from an upper surface side layer toward a running surface side layer, because of similar reasons to those described in Example 1. In Example 1, the overlap of warps owes to the action of a force due the design of running surface side wefts right adjacent thereto. Even insertion of one running surface side weft between them as in this Example is preferred, because if a long crimp formation portion is located adjacent to the woven portion, the action of a force to move the warps does not occur and the overlap of warps is not deteriorated.

In this running surface side weft design, a long crimp of running surface side wefts having a length corresponding to ten running surface side warps is formed on the running surface side surface, which improves wear resistance. In addition, in a portion of a running surface side weft which passes over a running surface side warp, passes under two successive running surface side warps, and passes over a running surface side warp, the running surface side weft is firmly woven by two running surface side warps with two other warps sandwiched therebetween so that the resulting fabric has excellent rigidity.

Conventional Example 1

In the design diagram of FIG. 12, a fabric of this conventional example 1 has one binding yarn arranged relative to one weft. In the design of an upper surface side surface, upper surface side warps and upper surface side wefts constitute a plain weave. In a binding design, a binding yarn passes over an upper surface side warp, passes between three upper surface side and running surface side warps, passes under a running surface side warp, and passes between five upper surface side warps and running surface side warps. Since the binding yarn does not participate in the surface design, the diameter of the binding yarn was made smaller than that of the upper surface side weft and at the same time marked protrusion from the upper surface side surface was prevented. The upper surface side surface design and binding design are similar to those employed in examples of the present invention.

In the design of a running surface side layer, a running surface side weft passes over a running surface side warp, passes under a running surface side warp, passes over a running surface side warp, and passes under seven successive running surface side warps, thereby forming a long crimp on the running surface side surface. A running surface side weft 2' adjacent to a running surface side weft 1' is arranged with a design obtained by shifting the design of the running surface side weft 1' by three warps. Weft 3' adjacent to the weft 2' and 4' adjacent to the weft 3' have also a complete design obtained by similarly shifting the designs of the wefts 2' and 3' by three warps, respectively. Employment of such a design deteriorates the overlap between upper surface side warps and running surface side warps owing to inevitable design–induced movement of the running surface side warps. FIG. 13 is a cross-sectional view of a fabric of the conventional example along wefts. Comparison between this diagram and FIG. 5 illustrating, along wefts, a fabric of the invention example clearly shows their difference in overlap. Moreover, comparison between the running surface side surface of the fabric of the conventional example shown in FIG. 14 and that of the invention example shown in FIG. 6 reveals uneven formation of drainage holes in the former one.

The overlap of upper surface side warps and running surface side warps of the fabric of the conventional example will next be described specifically. A running surface side weft 5' passes over a running surface side warp 1, passes under a running surface side warp 2, over a running surface side warp 3 and then, passes under seven successive running surface side warps 4, 5, 6, 7, 8, 9 and 10. In such a design of the conventional example in which a running surface side weft passes over a running surface side warp, passes under a running surface side warp and passes over a running surface side warp, a force to move the warps on both sides, here the running surface side warps 1 and 3, toward the running surface side warp 2 located inside thereof, whereby the running surface side warps 1, 2 and 3 get close to each other. When upper surface side warps are arranged regularly at equal intervals, running surface side warps are not arranged regularly. In the example of the present invention, on the other hand, transfer of a running surface side warp is inhibited because of the design of running surface side wefts on both adjacent sides thereto or a running surface side weft adjacent thereto with one weft sandwiched therebetween. In the fabric design of the conventional example 1, transfer of running surface side warps occurs, because a force to offset a force to get running surface side warps close to each other is not generated from two running surface side wefts arranged adjacent to each other or adjacent to each other with one-weft sandwiched therebetween.

Provided by the present invention is a two-layer fabric used for transport or dehydration. It is particularly useful as a papermaking fabric, because it is excellent in water draining property, fiber supporting property and wear resistance.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-242201 filed Aug. 23, 2004 including specification, drawings and claims is incorporated herein by reference in its entirety.

What is claimed is:

1. An industrial two-layer fabric obtained by weaving an upper surface side layer made of upper surface side warps and upper surface side wefts and a running surface side layer made of running surface side warps and running surface side wefts by binding yarns, characterized in that the running surface side wefts constituting the running surface side layer each has a design in which the running surface side weft passes over a running surface side warp, passes under two successive running surface side warps, passes over a running surface side warp and passes under at least four successive running surface side warps, thereby forming a long crimp of the weft on the running surface side surface; a running surface side weft adjacent to the above-described weft or adjacent to the above-described weft with one weft sandwiched therebetween is arranged with a design obtained by shifting the design of the above-described weft by two running surface side warps; and the design of the running surface side warps is formed of a portion passing under a running surface side weft and a portion passing over at least two running surface side wefts.

2. An industrial two-layer fabric according to claim 1, wherein a complete design of the running surface side layer constituting the two-layer fabric is made of n (n stands for an even number of 8 or greater) running surface side warps and n/2 running surface side wefts; the running surface side wefts each passes over a running surface side warp, passes under two successive running surface side warps, passes over a running surface side warp, and passes under n−4 successive running surface side warps, thereby forming a long crimp on the running surface side surface; in any two adjacent running surface side wefts, one is arranged with a design obtained by shifting the design of the other one by two running surface side warps; the running surface side warps have a design in which each running surface side warp passes under a running surface side weft, and then passes over n/2−1 running surface side wefts.

3. An industrial two-layer fabric according to claim 1, wherein a complete design of the running surface side layer constituting the two-layer fabric is made of n (n stands for an even number of 8 or greater) running surface side warps and n running surface side wefts; the running surface side wefts each passes over a running surface side warp, passes under two successive running surface side warps, passes over a running surface side warp, and passes under n−4 successive running surface side warps, thereby forming a long crimp on the running surface side surface; in any two adjacent running surface side wefts, a portion of one running surface side weft which passes over a running surface side warp, passes under two successive running surface side warps and passes over a running surface side warp is always adjacent to a portion of the other running surface side weft which forms a long crimp corresponding to at least four warps; in any two running surface side wefts adjacent to each other with one weft sandwiched therebetween, one running surface side weft is arranged with a design obtained by shifting the design of the other running surface side weft by two running surface side warps; and the running surface side warps have a design in which each of the warps passes under a running surface side weft, passes over at least two running surface side wefts, passes under a running surface side weft, and then passes over at least 2 running surface side wefts.

4. An industrial two-layer fabric according to claim 1, wherein a complete design of the running surface side layer constituting the two-layer fabric is made of n (n stands for an even number of 8 or greater) running surface side warps and n/2 running surface side wefts; the running surface side wefts each passes over a running surface side warp, passes under two successive running surface side warps, passes over a running surface side warp, and passes under n−4 successive running surface side warps, thereby forming a long crimp on the running surface side surface; in any two running surface side wefts adjacent to each other, a portion of one running surface side weft which passes over a running surface side warp, passes under two successive running surface side warps and passes over a running surface side warp is adjacent to a portion of the other running surface side weft which forms a long crimp corresponding to at least four warps; in any two running surface side wefts adjacent to each other with one weft sandwiched therebetween, one running surface side weft is arranged with a design obtained by shifting the design of the other running surface side weft by two running surface side warps; and the running surface side warps have a design in which the running surface side warps each passes under a running surface side weft and passes over n−1 running surface side wefts.

5. An industrial two-layer fabric according to claim 1, wherein the binding yarns for weaving the upper surface side layer with the running surface side layer are arranged between the wefts, have a smaller diameter than the upper surface side wefts and have a structure preventing the protrusion of the binding yarns from the surface.

6. An industrial two-layer fabric according to claim 1, wherein the binding yarns for weaving the upper surface side layer with the running surface side layer are arranged in pairs between the upper surface side weft; one of the pair of binding yarns is woven with the upper surface side warp to form the upper surface side surface, while below the upper surface side surface, the other binding yarn is woven with the running surface side warp to bind the two layers; and the two binding yarns as a pair are woven with the upper surface side warp and running surface side warp alternately to form the upper surface side surface design.

7. An industrial two-layer fabric according to claim 1, wherein a design of the upper surface side surface formed by the upper surface side warps and upper surface side wefts, or by the upper surface side warps, upper surface side wefts and auxiliary weft binding yarns is one of a plain weave design and a broken twill weave design.

* * * * *